US005746179A

United States Patent [19]

Little

[11] Patent Number: 5,746,179

[45] Date of Patent: May 5, 1998

[54] THROTTLE CONTROL DEVICE

[75] Inventor: Arthur J. Little, Seneca, S.C.

[73] Assignee: The Nason Company, West Union, S.C.

[21] Appl. No.: 720,086

[22] Filed: Sep. 27, 1996

Related U.S. Application Data

[60] Continuation of provisional application No. 60/025,118, Aug. 30, 1996.

[51] Int. Cl.[6] ..... F02D 11/00; F15B 7/00

[52] U.S. Cl. ..... 123/401; 60/533

[58] Field of Search ..... 123/401, 342; 60/593, 533; 92/13.8

[56] References Cited

U.S. PATENT DOCUMENTS

| | | | |
|---|---|---|---|
| 1,541,996 | 6/1925 | Oliver | 417/29 |
| 1,725,273 | 8/1929 | Hollander et al. | 417/34 |
| 1,859,283 | 5/1932 | Barton | 417/364 |
| 2,346,015 | 4/1944 | Eaton | 92/13.8 |
| 2,420,515 | 5/1947 | Barton | 417/34 |
| 2,820,414 | 1/1958 | Fejedelem | 417/34 |
| 2,931,305 | 4/1960 | Stratton | 417/34 |
| 2,966,143 | 12/1960 | Panza | 92/13.8 |
| 3,447,556 | 6/1969 | Howeth | 137/112 |
| 3,459,131 | 8/1969 | Senf | 417/34 |
| 3,942,325 | 3/1976 | Howeth | 60/533 |
| 3,973,472 | 8/1976 | Russell, Jr. | 92/13.6 |
| 4,024,711 | 5/1977 | Russell, Jr. | 60/423 |
| 4,247,082 | 1/1981 | Sjolund | 254/93 R |

FOREIGN PATENT DOCUMENTS 743161 10/1954 United Kingdom .

*Primary Examiner*—Willis R. Wolfe
*Assistant Examiner*—Hieu T. Vo
*Attorney, Agent, or Firm*—Fay, Sharpe, Beall, Fagan, Minnich & McKee

[57] ABSTRACT

The present invention is directed to a throttle control device to be used in combination with an engine having a throttle and a pump driven by the engine. The automatic control device has a housing defining a chamber having a first opening adapted to receive a fluid containing conduit in communication with the pump. A piston is slideably mounted in the chamber and has a first end acted on by a fluid contained in the conduit. A spring surrounds a portion of the piston within the chamber and biases the piston towards the first opening and, therefore, the fluid. A second end of the piston extends through a second opening in the chamber and controls the throttle. A first adjustable stop in the chamber limits travel of the piston and a second adjustable stop controls the compression of the spring.

12 Claims, 2 Drawing Sheets

THROTTLE CONTROL DEVICE

This application is a continuation of provisional application, U.S. Ser. No. 60/025.118, filed Aug. 30, 1996.

BACKGROUND OF THE INVENTION

1. Field of the Invention

This invention relates to a device which monitors the load on a hydraulic or pneumatic system and controls the throttle of an engine to achieve an appropriate speed to meet requirements of the hydraulic or pneumatic system. More particularly, this invention relates to a device which increases the engine speed of a vehicle simultaneously with increasing load in a hydraulic or pneumatic system to provide increased power to the hydraulic or pneumatic system.

The throttle control device of the present invention is particularly well suited to be used on a forklift vehicle or a truck having hydraulically operated systems such as dump bodies, lift platforms and the like. Throughout the specification, numerous references will be made to the use of the throttle control device in a truck or forklift environment. However, it should be realized that the invention can be used in any apparatus in which it is desirable to increase engine power to match an increase in work being performed by a separate system of a vehicle.

2. Description of the Art

It is recognized that the speed of the engine, particularly an internal combustion engine controlled by a carburetor or an injection type system—generally known as a diesel engine—decreases with increasing load on the engine. Moreover, unless the throttle controlling the carburetor or the injector is opened further, the speed of the engine will remain constant or may even slow. However, there are many instances where it is disadvantageous to have the engine slow in response to changing systematic requirements on the vehicle. For example, when the hydraulic system of a forklift is being operated or the hydraulic ram of a dump truck is operated, the load on the engine increases because of the power required to operate the hydraulic system. Accordingly, since the hydraulic pump is driven by the engine, it is desirable to increase engine power to increase the power available to the hydraulic pump.

In fact, a variety of throttle control devices exist, such as those described in U.S. Pat. Nos. 1,541,996; 1,725,273; 1,859,283; 2,420,515; 2,820,414; 2,931,305; 3,447,556; 3,459,131; and 3,973,472, herein incorporated by reference. However, as mechanical sophistication has improved over time, so have the requirements of a throttle control device. More specifically, the apparatus described in the above-referenced patents fail to allow the amount of factory and after installation adjustability and precision required in today's systems.

SUMMARY OF THE INVENTION

Accordingly, it is a primary object of this invention to provide a new and improved throttle control device.

It is an advantage of the present invention to provide a throttle control device which is adjustable to achieve sensitivity and reactivity to a particular pressure range in a pneumatic or hydraulic system.

A further advantage provided by the present inventive throttle control is an adjustable travel in the throttle control mechanism.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing objects in accordance with the purpose of the invention, as embodied and broadly described herein, the throttle control device of this invention comprises a cylinder having opposed openings at its ends. One of the ends of the cylinder is adapted to mate with a fluid containing line, for example, a hydraulic line. Within the cylinder, a reciprocating piston is housed. One end of the piston is exposed to the fluid which enters the cylinder, i.e., at the fluid inlet end, while a second end extends outwardly from the opposed end of the cylinder, i.e., the throttle control end. This throttle control end of the piston is typically disposed adjacent an engine carburetor or fuel injector control.

The piston is preferably formed to have its smallest diameter adjacent each end, a largest diameter disposed inwardly from the fluid inlet end, and an intermediate diameter disposed inwardly from the throttle control end. Of course, the fluid inlet end diameter is a function of the expected fluid pressure. Moreover, the diameter could, in fact, be any size required to provide a sufficient exposed surface area on which the fluid can act. The largest diameter of the piston is preferably sized to provide a close fit with the inner walls of the main chamber of the cylinder. However, the cylinder also includes a shoulder disposed inwardly from the fluid inlet end which acts as a stop in the direction of the fluid inlet against the largest diameter portion of the piston. A spring surrounds the intermediate diameter portion of the piston, abuts the largest diameter portion of the piston, and is contained by the inner walls of the main body of the cylinder. A ring shaped spring stop is positioned at the throttle control end of the cylinder, compressing the spring against the largest diameter portion of the piston. It is an important aspect of this invention that the spring stop is adjustable, preferably because it is threaded to the interior walls of the cylinder, to allow the compression of the spring to be tailored, and the pressure sensitivity of the device to be easily adjusted.

In its assembled position, the spring is compressed between the largest diameter portion of the piston and the spring stop engaged in the cylinder and provides a bias against the pressurized fluid entering the inlet end of the device. Disposed inwardly of the spring stop is a ring shaped piston stop having a bore sized to accommodate the smallest diameter end portion of the piston yet narrower than the intermediate diameter portion of the piston. It is an additional important aspect of this invention that the piston stop is adjustable, preferably by being threaded to the inner walls of the ring shaped spring stop, to allow adjustment of the travel of the piston.

BRIEF DESCRIPTION OF THE DRAWINGS

The invention consists in the novel parts, construction, arrangements, combinations and improvements shown and described. The accompanying drawings, which are incorporated in and constitute a part of the specification illustrate one embodiment of the invention and, together with a description, serve to explain the principals of the invention.

Of the drawings.

DETAILED DESCRIPTION OF THE INVENTION

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications and equivalents as may be included within the spirit and scope of the invention defined by the appended claims.

As one skilled in the art will understand, the present inventive throttle control device provides a mechanism to sense an increased load on a hydraulic or pneumatic system via the associated rise in fluid pressure. Particularly, a sufficient increase in fluid pressure pushes against a piston, compressing the spring if the critical pressure is present, which in turn pushes the second end of the piston against the throttle of the engine, causing it to speed up. The adjustability of the present inventive device is an important advantage over prior designs. Particularly, obtaining the stroke of the piston at a precise fluid pressure is a critical advantage. Obtaining this result is complicated because of the variations in compression rates of the springs suited to the present application. Moreover, to obtain exactly the right amount of travel, at a precise pressure, the device must be adjustable. The present inventive design allows for adjustment of these parameters subsequent to manufacture and after extended use. Accordingly, by pre-compressing a spring at the factory, using the specific adjustment mechanisms provided by the present inventive design, a very precise point on the slope of the compression curve can be obtained to achieve the desired travel, at an identified pressure.

Figure 1:
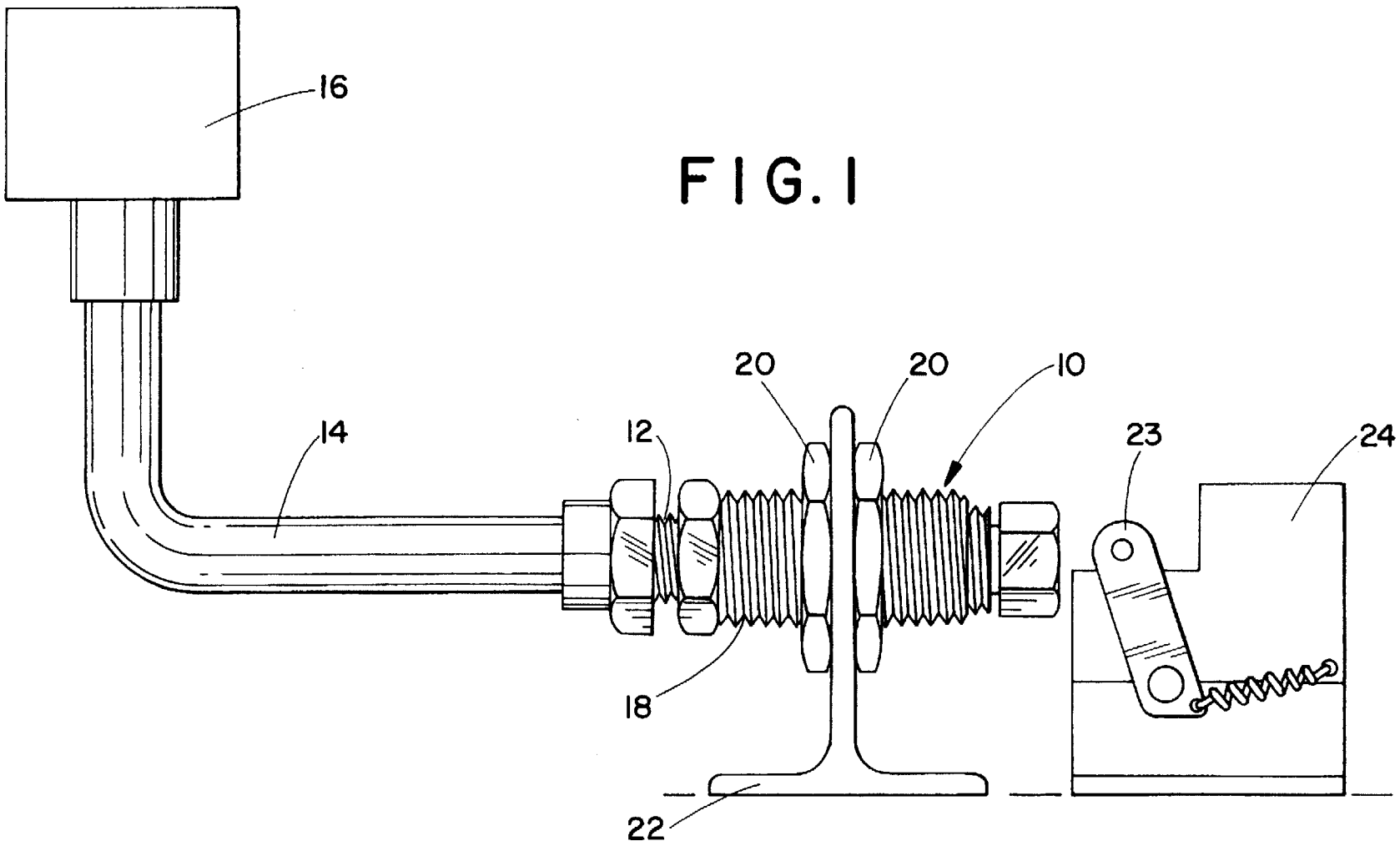
FIG. 1 is a schematic representation of a system containing a throttle control mechanism according to this invention.

Referring now to the figures, specifically FIG. 1, throttle control device 10 is depicted. As demonstrated, inlet end 12 of the device is threadedly connected to fluid line 14 which is connected to a high pressure hydraulic system 16. The outer wall 18 of throttle control device 10 is threaded to accommodate a pair of hex nuts 20 which journal a bracket 22 to secure throttle control device 10 at an appropriate location adjacent throttle 23 on carburetor 24.

Figure 2:
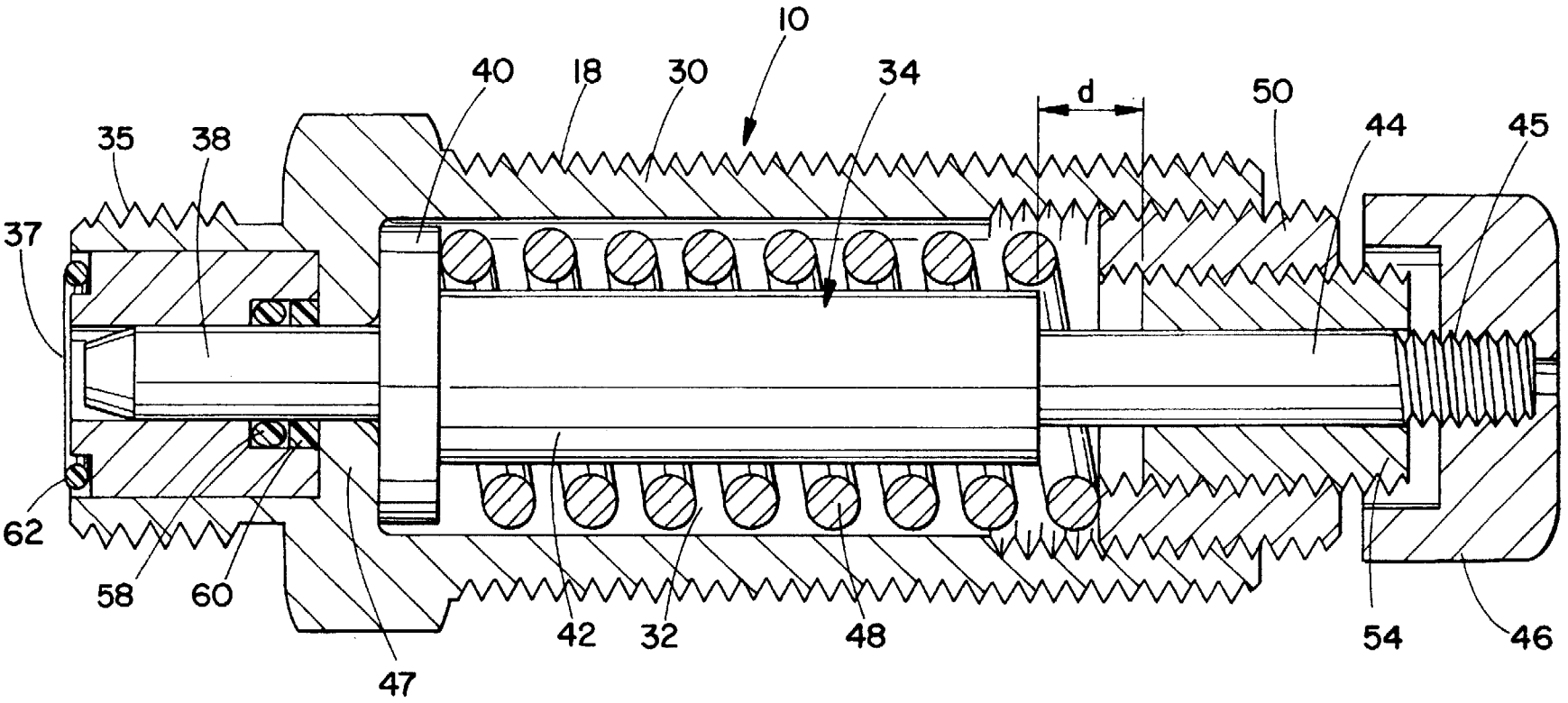
FIG. 2 is a cross-section of the throttle control mechanism of this invention.

With specific reference to FIG. 2, throttle control device 10 is comprised of a cylindrically shaped main body 30 having a chamber 32 in which piston 34 is housed. Main body 30 includes threaded outer wall 18 and a threaded end portion 35 to mate with the hydraulic line 14 (see FIG. 1) forming a fluid inlet 37. Piston 34 includes a first fluid inlet portion 38, a collar portion having a largest diameter 40, an intermediate diameter midsection 42, and a throttle control end portion 44 having a narrow diameter and terminating in a threaded section 45 to mate with cap 46. As shown, collar portion 40 is positioned adjacent a shoulder 47 formed in chamber 32 of cylinder 30. Accordingly, travel of the piston in the direction of the fluid inlet is limited by the relative dimensions of these elements.

Travel of piston 34 in the direction fluid inlet 37 is caused by spring 48 which surrounds midsection 42 of piston 34 and is compressed between collar portion 40 and spring stop 50 formed by a ring threaded into chamber 32. Travel of piston 34 in the direction of the throttle 23 (see FIG. 1) is limited by piston stop 54 formed of a ring threaded into an interior bore of spring stop 50. However, the throttle control end portion 44 is narrow enough to fit through the bore in piston stop 54 creating a travel distance ("d").

To provide a generally fluid tight environment, fluid inlet 37 of the chamber 32 includes a first seal 58 held in place by back-up ring 60. In addition, compression O-ring 62 is positioned adjacent fluid inlet 37 to form a seal with hydraulic line 14 (See FIG. 1).

After assembly of the device, the amount of pressure required to achieve a desired travel of the piston can be calibrated by adjustment of the spring stop. Once the desired characteristics are obtained, the spring stop and piston stop can be more permanently secured with any commercial thread lock.

In preferred embodiments, the piston stop, spring stop, cap, cylinder, hex nuts, and piston are comprised of steel coated with a zinc-chromate plating to prevent corrosion. The back-up ring, seal and O-ring are constructed of any material known to those skilled in the art. Of course, the invention is not intended to be limited in any respect to the particular materials depicted in this preferred embodiment.

Thus it is apparent that there has been provided, in accordance with the invention, a throttle control device that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An apparatus to automatically control a throttle of an engine which provides power to a hydraulic or pneumatic system, the apparatus comprised of a housing defining a chamber, said chamber having a first opening comprised of a channel having a diameter narrower than said chamber adapted to receive a fluid containing conduit in communication with said system, a piston slidably mounted in said chamber and having a main body portion within said chamber and a first end with a narrower diameter than said main body positioned within said channel which is acted on by a fluid in said conduit, a spring surrounding a portion of said piston within said chamber and biasing said piston towards said first opening, said piston including a second end extending through a second opening in said chamber which controls said throttle, said second opening including an adjustable stop which limits travel of said piston and an adjustable member which controls the compression of said spring.

2. The apparatus of claim 1 further comprising a cap positioned on said second end of said piston.

3. The apparatus of claim 1 further comprising a seal positioned between an interior wall of said chamber and said first end of said piston.

4. The apparatus of claim 2 wherein said cap is threadedly engaged with said second end of said piston.

5. The apparatus of claim 1 wherein said adjustable member is threadedly engaged with an interior wall of said chamber.

6. The apparatus of claim 5 wherein said adjustable stop is threadedly engaged with an interior wall of said spring.

7. The apparatus of claim 1 wherein an outer wall of said housing is threaded.

8. The apparatus of claim 1 wherein said piston includes at least three sections having different diameters.

9. The apparatus of claim 8 wherein said piston includes two ends having narrowest diameters.

10. A throttle control mechanism comprising a cylinder having first and second openings at each end thereof, said cylinder having a threaded outer wall and a first end adapted to mate with a fluid containing conduit, a piston reciprocable within said cylinder and having a fluid inlet end and a throttle control end, said piston having a narrowest diameter adjacent each end, a largest diameter inward from said fluid inlet end, and an intermediate diameter inward from said throttle control end, said cylinder including a main chamber having a diameter sufficient to accommodate said largest diameter of said piston and a passage with a restricted diameter between said main chamber and said first end, said fluid inlet end of said piston extending through said restricted diameter passage which acts as a stop against the largest diameter of said piston, a seal located between said fluid inlet end of said piston and an inner wall of said chamber, a spring surrounding said intermediate diameter portion of said piston within the main chamber of said cylinder, a first end of said spring stopped by the largest diameter portion of said piston and a second end of said spring stopped by a first ring threaded into the second end of said cylinder, a second ring threaded into the interior of the said first ring and creating a passage in said second end of said cylinder large enough to accommodate said smallest diameter of said piston and acting as a stop against said intermediate diameter of said piston, said spring providing a bias against a fluid in said conduit, said spring stop and said piston stop being threadedly adjustable along a longitudinal axis of the said cylinder to tailor the resistance to pressure and travel of said piston.

11. The apparatus of claim 10 further comprising a cap positioned on said second end of said piston.

12. In combination with an engine having a throttle and a pump driven by said engine, an automatic control device comprising a cylindrical housing having a threaded outer wall and defining a chamber, said chamber having a first opening adapted to receive a fluid containing conduit in communication with said pump, a piston slidably mounted in said chamber and having a first end acted on by a fluid from said conduit, a spring surrounding a portion of said piston within said chamber and biasing said piston towards said first opening, said piston including a second end extending through a second opening in said chamber which controls said throttle, said chamber including a first adjustable stop which limits travel of said piston and a second adjustable stop which controls the compression of said spring, a bracket mounted to said engine and including a threaded portion mated to said threaded outer wall of said automatic control device to facilitate longitudinal axial adjustment thereof.

* * * * *